United States Patent [19]

Dibowski et al.

[11] Patent Number: 4,705,223

[45] Date of Patent: Nov. 10, 1987

[54] BOWL MILL

[75] Inventors: Günter Dibowski, Essen; Helmut Grommes, Duisburg, both of Fed. Rep. of Germany

[73] Assignee: Deutsche Babcock Werke Aktiengesellschaft, Oberhausen, Fed. Rep. of Germany

[21] Appl. No.: 798,480

[22] Filed: Nov. 15, 1985

[30] Foreign Application Priority Data

Nov. 30, 1984 [DE] Fed. Rep. of Germany ..... 3443716

[51] Int. Cl.[4] ..... B02C 4/02; B02C 15/04

[52] U.S. Cl. ..... 241/117; 241/121

[58] Field of Search ..... 241/117, 121, 127–132

[56] References Cited

U.S. PATENT DOCUMENTS

| | | | |
|---|---|---|---|
| 3,658,264 | 4/1972 | Schauer | 241/121 |
| 3,782,646 | 1/1974 | Brundiek | 241/117 |
| 4,147,308 | 4/1979 | Mikkelsen | 241/117 |

FOREIGN PATENT DOCUMENTS 2839815 3/1980 Fed. Rep. of Germany .

OTHER PUBLICATIONS

Babcock, "The MPS Type Roller Mill for Grinding Bituminous Coal" by Günter Schneider, 1971, pp. 3 and 13.

*Primary Examiner*—Timothy V. Eley
*Attorney, Agent, or Firm*—Max Fogiel

[57] ABSTRACT

A ball mill with a housing (1) that accommodates three stationary rollers (2) rolling along a rotating track (3). The rollers are held against the track by means of an upper and lower frame (9 & 10). The frames have springs (11) between them. Rods (8), each connected to a hydraulic cylinder (24) and extending out of the housing, engage the upper frame (9). To allow the rollers to be lifted off the track, a piston associated with the hydraulic cylinder can be charged at either end, the rollers are attached to the lower frame with hinges 25 and an angle-setting device, and the frames are connected by tension structures that limit the expansion of the springs.

11 Claims, 4 Drawing Figures

BOWL MILL

Figure 1:
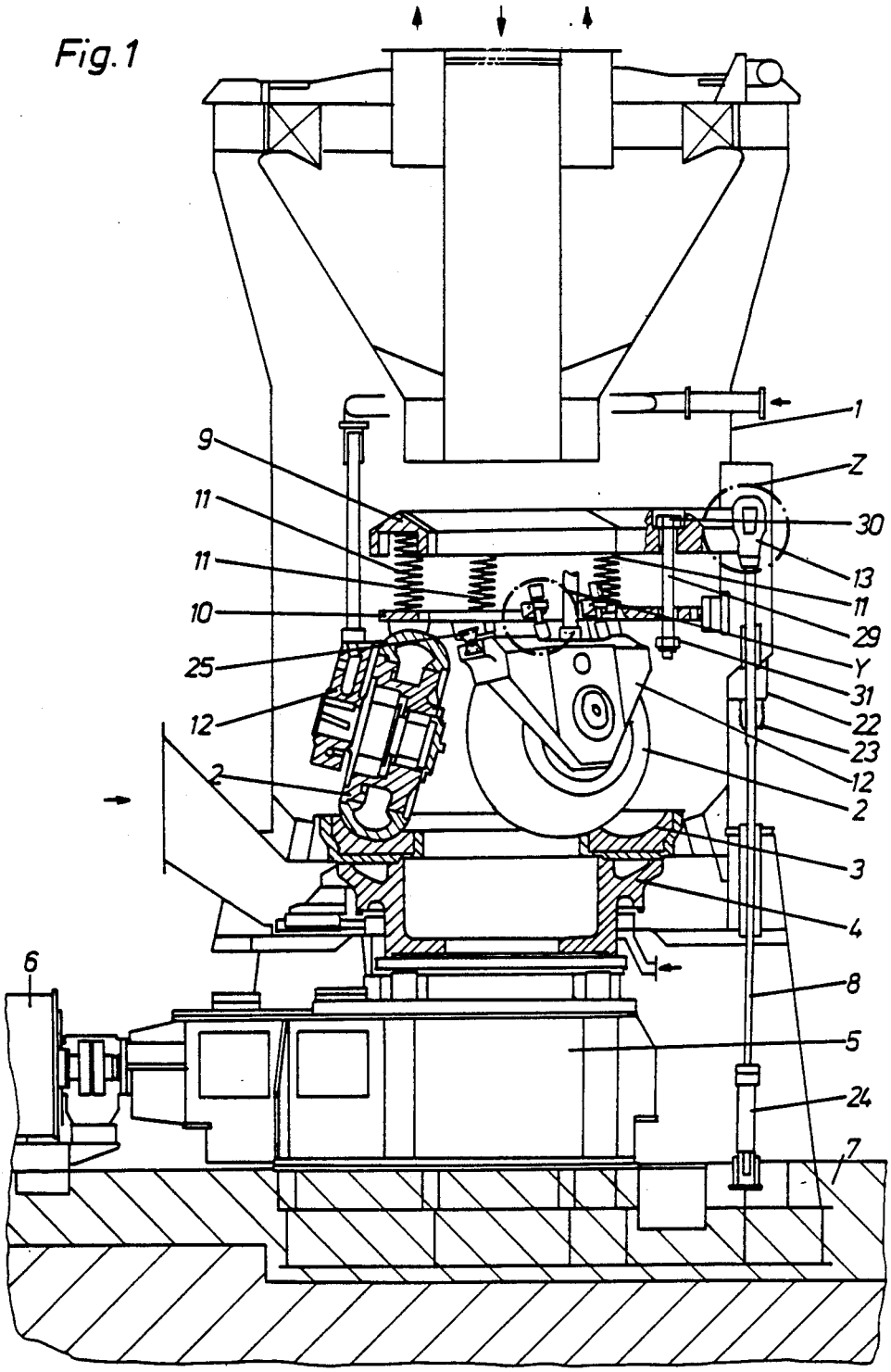

The invention concerns a bowl mill with the characteristics in the preamble to claim 1.

A bowl mill of this type is known from *Aufbereitungs-Technik* 12 (1971), pages 537 to 549. The milling force is applied with tension structures like cables or rods that engage an upper frame and are secured to the base of the mill. The force is transmitted from the upper frame to a lower frame through springs and hence to the rollers. The springs, which are helical, are simple and reliable.

The way the rollers are accommodated in the housing, however, prevents them from being lifted off of the milling track over the frames and lowered again. Lifting them can be desirable for example when a malfunction in the combustion chamber of the boiler served by the mill suddenly interrupts the supply of hot air to the mill, leaving a supply of coal in the mill reservoir. If the rollers could be lifted in such a situation, the material being milled could be removed from the mill while the bowl continued to rotate.

A bowl mill in which the rods that transmit the milling force can be shifted back and forth with hydraulic cylinders is known from Grman OS No. 2 839 815. The rods engage a one-part frame through the intermediary of hinged joints. The rollers are mounted on holders on the frame in such a way that they can be lifted off the track along with the frame, returning to their original position on the track when lowered again. Still, the rollers in this mill must be held against the track resiliently by the hydraulic cylinders, which is very expensive from an engineering aspect.

The object of the invention is to provide a mill in which the rollers can be held against the track resiliently by simple means and lifted off the track.

This object is attained in a mill of the overall type by means of the characteristics in the body of claim 1. Practical embodiments of the invention will be evident from the subsidiary claims.

The springs between two frames can be retained in this mill because they are not completely released when the tensioning structures lift the frames, and their position between the frames will remain secure.

One embodiment of the invention is illustrated in the drawings and will now be described in detail.

Figure 2:
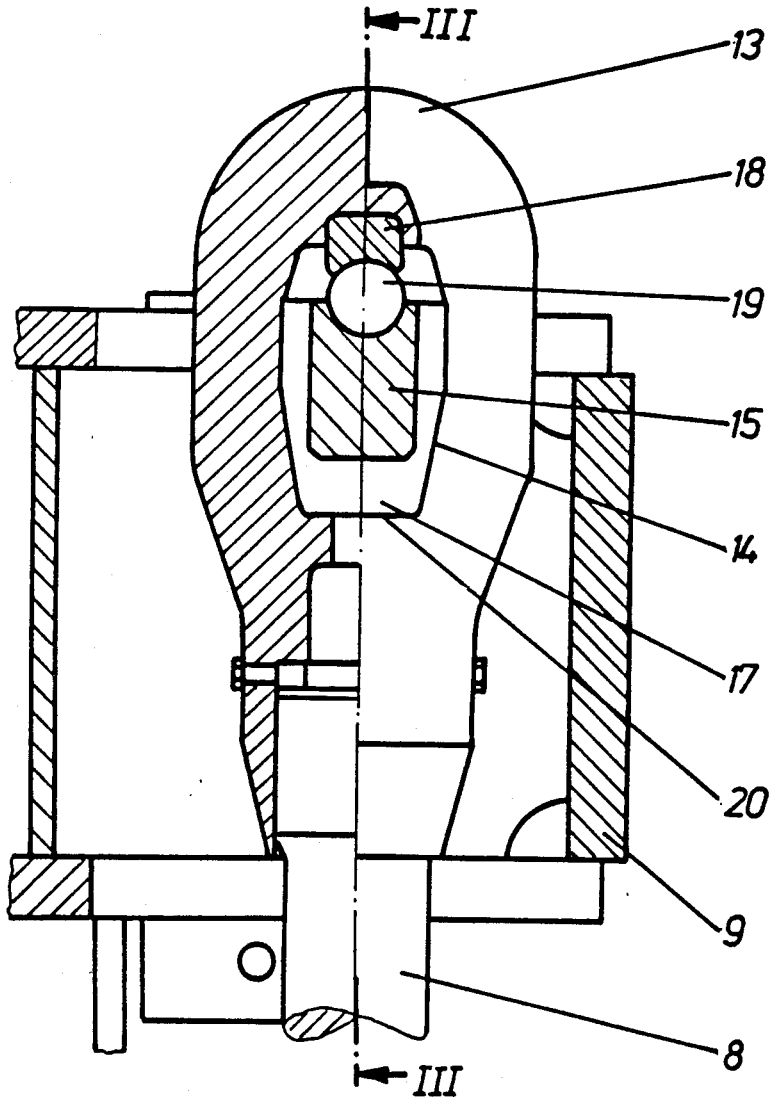
Figure 3:
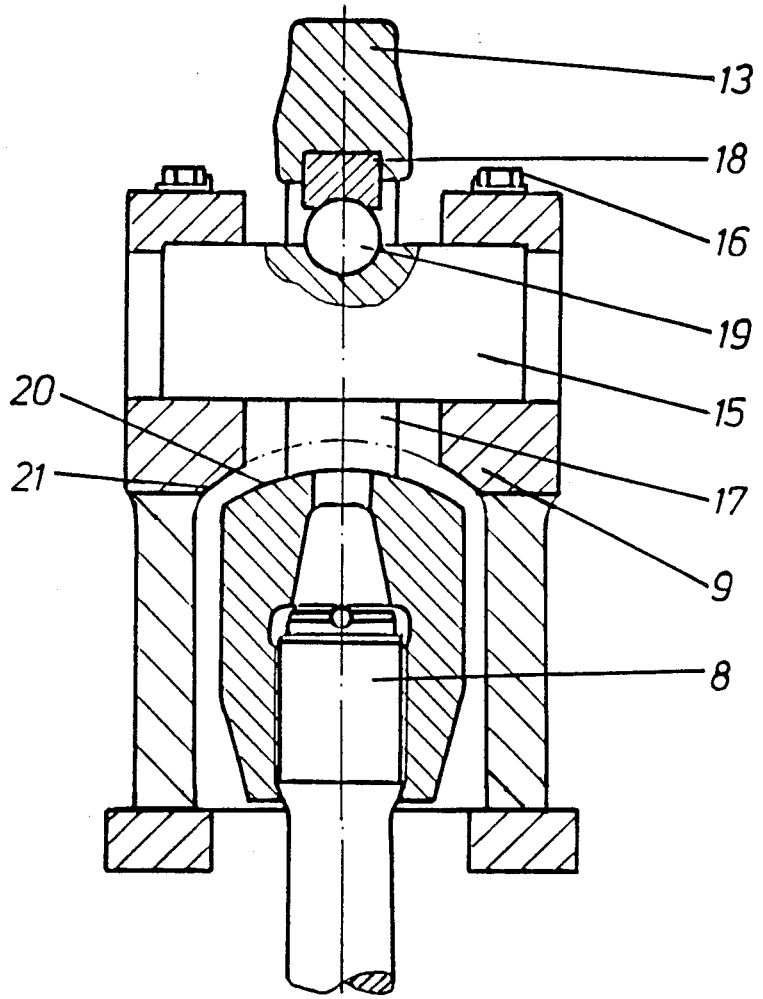
Figure 4:
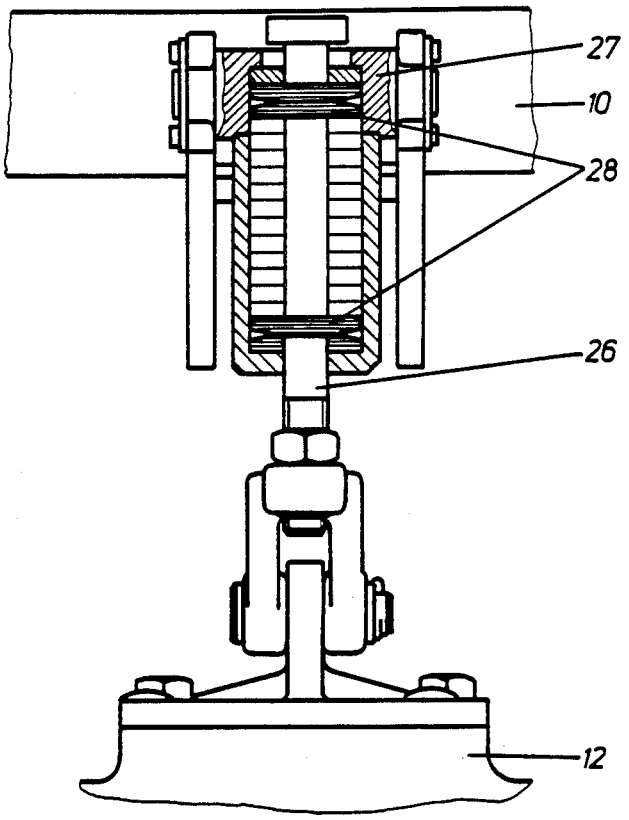

FIG. 1 is a longitudinal section through a bowl mill in accordance with the invention, FIG. 2 is a detail of area Z in FIG. 1, FIG. 3 is a section along line III—III in FIG. 2, and FIG. 4 is a detail of area Y in FIG. 1.

A bowl mill has a housing 1 that accommodates the milling mechanisms. The milling mechanisms consists of three stationary rollers 2 that roll over the track 3 of a rotating bowl 4. Bowl 4 is vertically oriented and mounted on a drive mechanism 5 that powers it from a motor 6. Drive mechanism 5 rests on a base 7.

The milling force is transmitted through rods 8 secured in base 7. Rods 8 engage a resilient structure consisting of an upper and lower frame 9 and 10. Between frames 9 and 10 are springs 11, preferably helical. Rollers 2 are attached to lower frame 10 with roller mounts 12 at an angle to the vertical. The milling force transmitted to upper frame 9 through rods 8 is forwarded to rollers 2 through springs 11, lower frame 10, and roller mounts 12 in such a way that the rollers are held against track 3 at a prescribed level of resiliency.

Rods 8 are articulated to upper frame 9 with a hinged joint. A head 13 that accommodates an eye 14 is fastened to the top of rod 8. A clamp 15 passes through eye 14 and is secured in upper frame 9 with screws 16. Clamp 15 is accommodated in the recess in a fork 17 positioned along with a lining 18 in the eye 14 in head 13. Between the lining 18 resting against head 13 and the clamp 15 secured to upper frame 9 is a ball 19. The bottom of head 13 has a concave contact surface 20 that faces a matching convex contact surface 21 on upper frame 9.

Rod 8 extends out of housing 1 at a point that is sealed off with a dynamic seal. The dynamic seal consists of a sealing-air chamber 22 that has a sealing-air supply connection. Between sealing-air chamber 22 and rod 8 is a bellows 23.

The bottom of rod 8 is attached to a piston accommodated in a hydraulic cylinder 24 in such a way that it can be charged at either end. The piston can be constantly pressurized while the mill is in operation or can be mechanically blocked.

The mounts 12 that hold rollers 2 are attached to lower frame 10 with hinges 25. The angle of inclination of rollers 2 is secured by means of an angle-setting device that consists as illustrated in FIG. 4 of a bolt 26 articulated to roller mounts 12 and of a holder 27 fastened to lower frame 10. Bolt 26 is secured in holder 27 and rests against springs 28. A bushing can be employed instead of springs 28 if a rigid angle-setting device is employed instead of a resilient device. As will be evident from FIG. 1, there are two angle-setting devices for each roller 2. Bolt 26 is threaded. Displacing a nut along bolt 26 will vary the length of the bolt between holder 27 and roller mount 12. Each length represents in conjunction with hinges 25 a particular inclination of a roller 2 to the vertical. The angle of inclination can also be adjusted by employing bushings of different length.

Upper and lower frames 9 and 10 are connected by tension structures that limit the extension of springs 11 when frames 9 and 10 are forced apart. The tension structures preferably consist of threaded bolts 29 that extend through both frames 9 and 10. When the mill is in operation the contact surface of the head 30 of each threaded bolt 29 rests against upper frame 9, whereas a nut 31, which functions as a lower contact surface and is mounted on threaded bolt 29, is at a certain distance from the bottom of lower frame 10. Cables connected to frames 9 and 10 or hooks that engage the frames can be employed as tension structures instead of the threaded bolts. What is essential is the cables or hooks also only come into action and accordingly limit the expansion of springs 11 when frames 9 and 10 are forced apart.

When the mill is in operation, rods 8 are tensioned and the milling force is activated by charging hydraulic cylinder 24. Varying the pressure in hydraulic cylinders 24 will vary the milling force whether the mill is in or out of operation. When rollers 2 have to be lifted off of track 3, hydraulic cylinder 24 is shifted in such a way as to apply pressure to rods 8. The concave contact surface 20 on the head 13 of rod 8 thrusts against the matching convex contact surface 21 on upper frame 9 and lifts the frame. Once a stroke of a certain length has been completed, threaded bolts 29 will begin to entrain lower frame 10. Since springs 11 cannot expand completely, they will remain in place between frames 9 and 10. When rollers 2 are returned to track 3, they will assume their original position.

We claim:

1. A bowl mill comprising: a housing; a rotatable bowl; three rollers rotatably mounted on stationary axles and rolling on said bowl; said rollers and said bowl being surrounded by said housing; a rotating track on said bowl; an upper frame and a lower frame with springs between said upper frame and said lower frame for holding said rollers against said rotating track on said bowl; a plurality of rods connected to said upper frame; a hydraulic cylinder connected to each one of said plurality of rods, each one of said rods connected to said hydraulic cylinder extending out of said housing and toward said upper frame; a piston associated with said hydraulic cylinder being chargeable at either end; hinges for attaching said rollers to said lower frame, said rollers having an angle of inclination; angle-setting means for setting said angle of inclination; and tension means connecting said frames for limiting expansion of said springs, ball joints for connecting said rods to said upper frame.

2. A bowl mill comprising: a housing; a rotatable bowl; three rollers rotably mounted on stationary axles and rolling on said bowl; said rollers and said bowl being surrounded by said housing; a rotating track on said bowl; an upper frame and a lower frame with springs between said upper frame and said lower frame for holding said rollers against said rotating track on said bowl; a plurality of rods connected to said upper frame; a hydraulic cylinder connected to each one of said plurality of rods, each one of said rods connected to said hydraulic cylinder extending out of said housing and toward said upper frame; a piston associated with said hydraulic cylinder being chargeable at either end; hinges for attaching said rollers to said lower frame, said rollers having an angle of inclination; angle-setting means for setting said angle of inclination; and tension means connecting said frames for limiting expansion of said springs; each rod having a head with an eye; a clamp attached to said upper frame and extending through said eye; a ball secured between said clamp and inside of said eye; said head having a concave contact surface facing a matching convex contact surface on said upper frame.

3. A bowl mill comprising: a housing; a rotatable bowl; three rollers rotatably mounted on stationary axles and rolling on said bowl; said rollers and said bowl being surrounded by said housing; a rotating track on said bowl; an upper frame and a lower frame with springs between said upper frame and said lower frame for holding said rollers against said rotating track on said bowl; a plurality of rods connected to said upper frame; a hydraulic cylinder connected to each one of said plurality of rods, each one of said rods connected to said hydraulic cylinder extending out of said housing and toward said upper frame; a piston associated with said hydraulic cylinder being chargeable at either end; hinges for attaching said rollers to said lower frame, said rollers having an angle of inclination; angle-setting means for setting said angle of inclination; and tension means connecting said frames for limiting expansion of said springs; said angle-setting means comprising a holder attached to said lower frame; a bolt fastened to said rollers, said holder resting against said bolt.

4. A bowl mill as defined in claim 3, wherein said holder rests rigidly against said bolt.

5. A bowl mill as defined in claim 3 wherein said holder rests resiliently against said bolt.

6. A bowl comprising: a housing; a rotatabale bowl; three rollers rotatably mounted on stationary axles and rolling on said bowl; said rollers and said bowl being surrounded by said housing; a rotating track on said bowl; an upper frame and a lower frame with springs between said upper frame and said lower frame for holding said rollers against said rotating track on said bowl; a plurality of rods connected to said upper frame; a hydraulic cylinder connected to each one of said plurality of rods, each one of said rods connected to said hydraulic cylinder extending out of said housing and toward said upper frame; a piston associated with said hydraulic cylinder being chargeable at either end; hinges for attaching said rollers to said lower frames, said rollers having an angle of inclination; angle-setting means for setting said angle of inclination; and tension means connecting said frames for limiting expansion of said springs when said upper frame is raised by a predetermined amount.

7. A bowl mill as defined in claim 6, wherein each of said rods extends out of said housing at a location; and a dynamic seal for sealing off the location where each rod extends out of said housing.

8. A bowl mill as defined in claim 6, including ball joints for connecting said rods to said upper frame.

9. A bowl mill as defined in claim 6, wherein each rod has a head with an eye; a clamp attached to said upper frame and extending through said eye; a ball secured between said clamp and inside of said eye; said head having a concave contact surface facing a matching convex contact surface on said upper frame.

10. A bowl mill as defined in claim 6, wherein said angle-setting device comprises a holder attached to said lower frame; a bolt fastened to said rollers, said holder resting against said bolt.

11. A bowl mill as defined in claim 6, wherein said tension means includes bolts and nuts, said nuts abutting against the lower frame when the upper frame is raised by said predetermined amount.

* * * * *